US006003544A

United States Patent [19]

Turrin et al.

[11] Patent Number: 6,003,544

[45] Date of Patent: Dec. 21, 1999

[54] VALVE UNIT FOR CONTROLLING THE DELIVERY PRESSURE OF A GAS

[75] Inventors: Gianpiero Turrin, Padua; Luca Peron, Borgoricco; Daniele Sacchi, Mestre, all of Italy

[73] Assignee: Sit La Precisa S.r.l., Padua, Italy

[21] Appl. No.: 08/787,920

[22] Filed: Jan. 23, 1997

[30] Foreign Application Priority Data

Apr. 2, 1996 [EP] European Pat. Off. ..... 96830184

[51] Int. Cl.[6] ..... F16K 31/12

[52] U.S. Cl. ..... 137/489; 137/488

[58] Field of Search ..... 137/489, 488

[56] References Cited

U.S. PATENT DOCUMENTS

| | | | |
|---|---|---|---|
| 3,351,085 | 11/1967 | Allingham | 137/489 |
| 4,087,073 | 5/1978 | Rungber et al. | 137/489 |
| 4,406,400 | 9/1983 | Berkhof | 137/489 |
| 4,785,846 | 11/1988 | Kragten | 137/489 |
| 5,345,963 | 9/1994 | Dietiker | 137/489 |

FOREIGN PATENT DOCUMENTS

| | | | |
|---|---|---|---|
| 39000 | 11/1981 | European Pat. Off. | 137/489 |
| 62856 | 10/1982 | European Pat. Off. | 137/489 |
| 0272348 | 6/1988 | European Pat. Off. . | |
| 0697563 | 2/1996 | European Pat. Off. . | |
| 697563 | 2/1996 | European Pat. Off. | 137/489 |

*Primary Examiner*—Denise L. Ferensic
*Assistant Examiner*—Joanne Y. Kim
*Attorney, Agent, or Firm*—Sughrue, Mion, Zinn Macpeak & Seas, PLLC

[57] ABSTRACT

A valve unit comprises a single electromagnetic actuator for controlling both an ON-OFF valve for cutting off the gas and a modulation valve; the latter is subject to independent resilient loads for regulating the minimum pressure delivered and for regulating the pressure up to the maximum pressure at the modulation stage.

9 Claims, 5 Drawing Sheets

VALVE UNIT FOR CONTROLLING THE DELIVERY PRESSURE OF A GAS

BACKGROUND OF THE INVENTION

The present invention relates to a valve unit for controlling the delivery pressure of a gas according to the preamble to the main claim.

As is well known, these units are used for controlling the delivery of gas to a burner or to another similar user so as to vary its delivery pressure in a controlled manner according to predetermined physical parameters, for example, measured by an electric current supplied to the solenoid of an electromagnetic actuator of the valve unit.

The control carried out by means of these units typically provides a characteristic curve in which, below a certain minimum current value I0 no gas-flow is delivered, between the value I0 and an intermediate value I1 a minimum gas-flow is delivered, and between the intermediate value I1 and a higher value I2 the delivery pressure is modulated up to a maximum pressure value.

The control or the cutting-off of the gas delivery up to the minimum current value I0 is carried out by means of an on-off gas valve, whereas the subsequent control of the delivery pressure between the minimum and maximum pressure values is carried out by means of a servo-valve controlled by a modulation unit with a diaphragm. The diaphragm of this unit is acted on, on one side, by the delivery pressure of the gas as detected in the delivery duct to the user and, on the other side, by a resilient load which is subjected to the action of the movable device of an electromagnet and is variable between a minimum value and a maximum value in dependence on the current piloting the electromagnet.

A problem encountered with these known units is that of the correct regulation of the minimum value of the gas pressure delivered. This value depends upon the minimum resilient load acting on the diaphragm which in turn depends upon the position in which a control rod of the electromagnetic actuator stops against a low-point abutment. Naturally, the regulation of the minimum pressure is more precise the lower is the elastic constant of the spring acting on the diaphragm. The selection of this spring is therefore subject to a compromise between the need for stiffness to provide an appreciable variation of the resilient load at the stage of the modulation of the delivery pressure up to the maximum value and the need for softness to ensure precision and stability of adjustment during operation at the low point. The relative stiffness in the modulation stage is nevertheless important for bringing about sufficient variation of the resilient load within the limited travel available for the movable device of the electromagnetic actuator which brings about the pressure variation.

SUMMARY OF THE INVENTION

The problem upon which the invention is based is that of providing a valve unit which is designed structurally and functionally so as to avoid all of the problems complained of with reference to the prior art mentioned. Moreover, it is proposed to reduce the state of compromise explained above and thus to ensure stable and effective regulation of the unit in operation at the minimum pressure.

This problem is solved by the invention by means of a valve unit formed in accordance with the following claims.

BRIEF DESCRIPTION OF THE INVENTION

The characteristics and advantages of the invention will become clearer from the following detailed description of a preferred embodiment thereof, described by way of non-limiting example with reference to the following drawings, in which:

FIGS. 1 to 3 are longitudinal sections of a valve unit according to the invention, in three stages of operation, FIG. 4 is a functional diagram of a detail of the unit of the preceding drawings, FIG. 5 is a graph showing a characteristic curve of the valve unit of the invention.

DETAILED DESCRIPTION OF THE INVENTION

Figure 1:
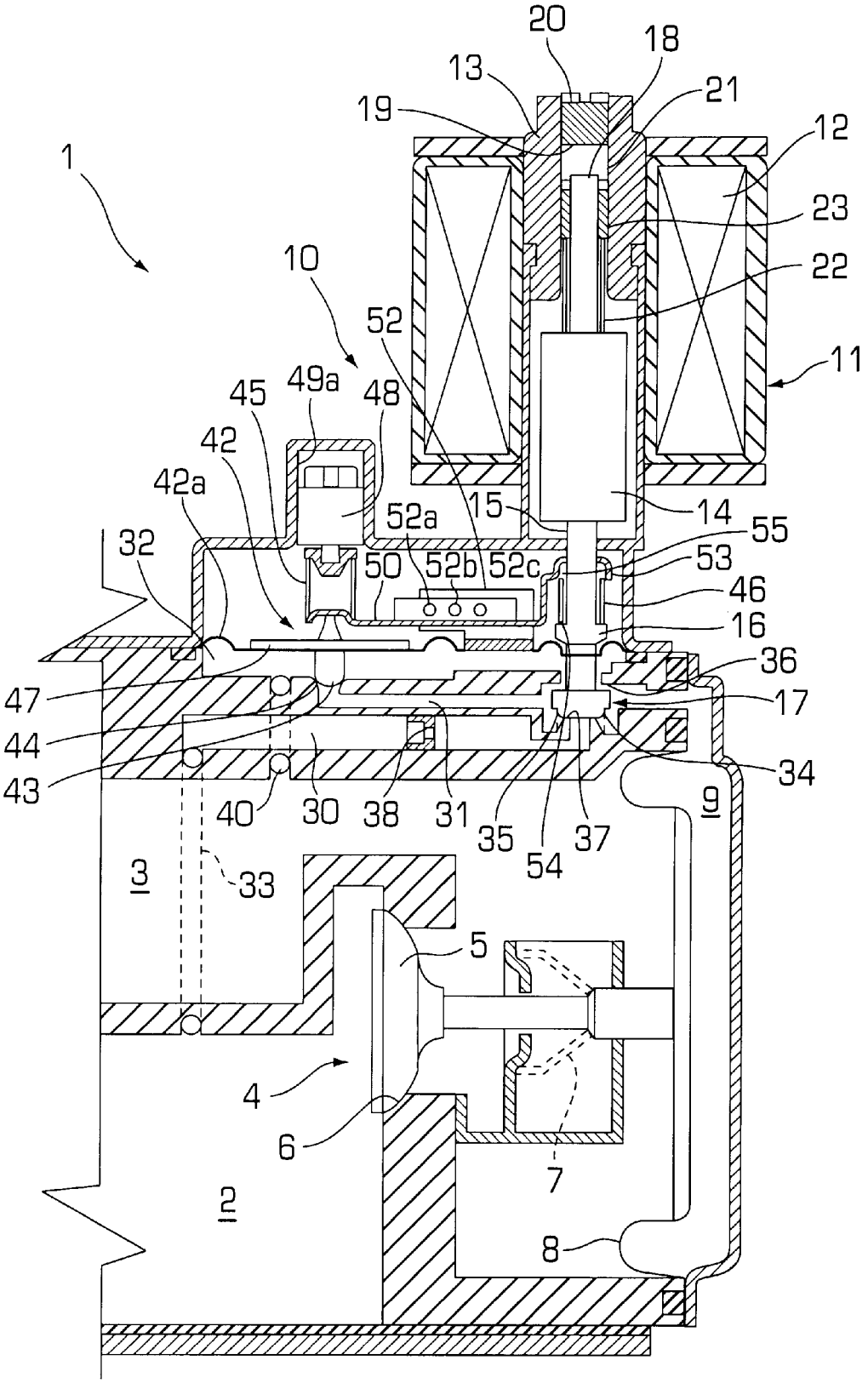

In the drawings, a valve unit, generally indicated 1, is for controlling the delivery pressure of a gas supplied to the unit, generally at a constant pressure pI, through a supply duct 2 and delivered thereby at a variable delivery pressure pU through a delivery duct 3. The ducts are separated by a servo-valve 4 including an obturator 5 which is resiliently urged into closure on a seat 6 by the resilient load of a spring 7 and can be opened by a diaphragm 8 which is sensitive to the differential detected between the pressure in the delivery duct 3, on the one hand, and the pressure in a piloting chamber 9, on the other hand.

Figure 4:
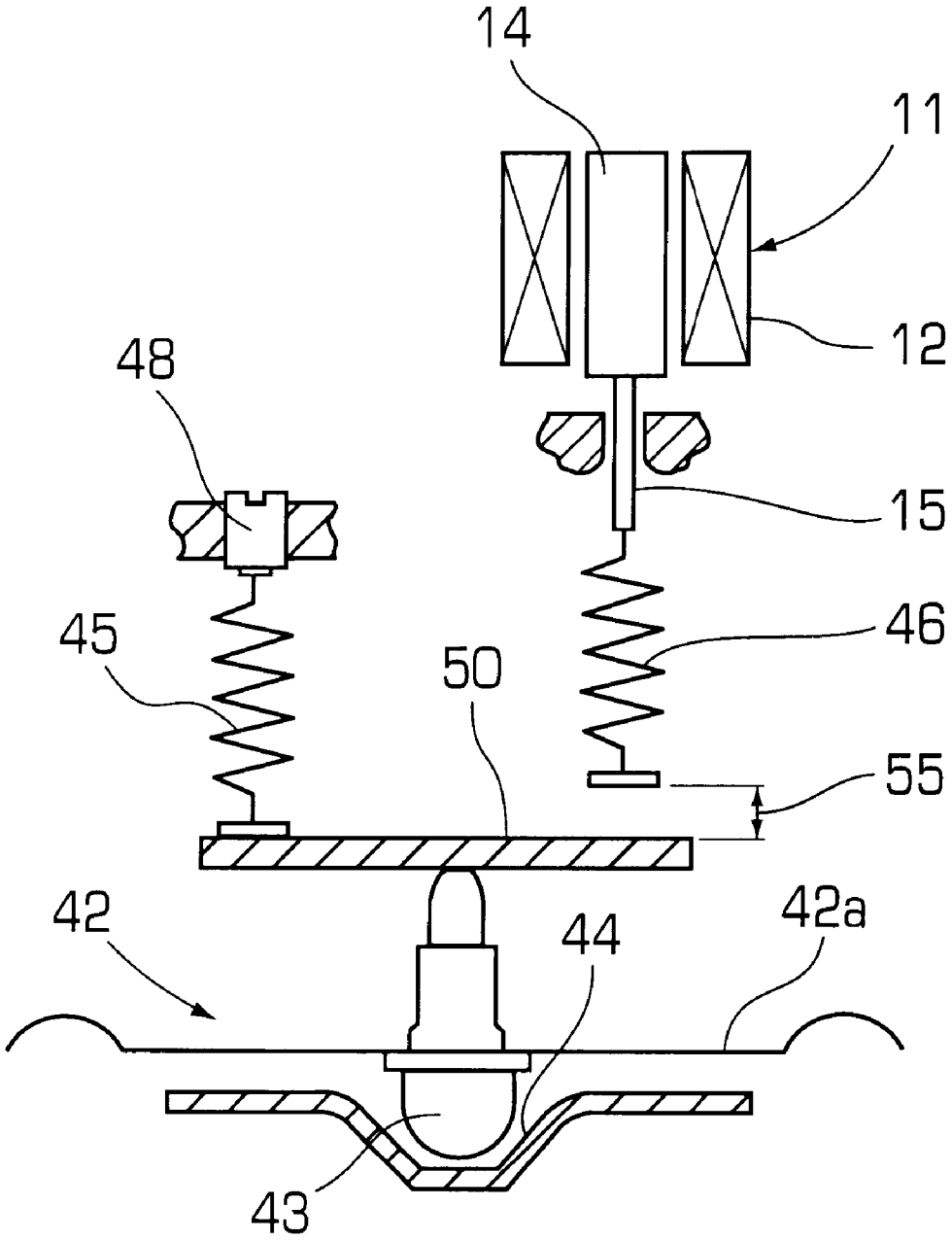
Figure 5:
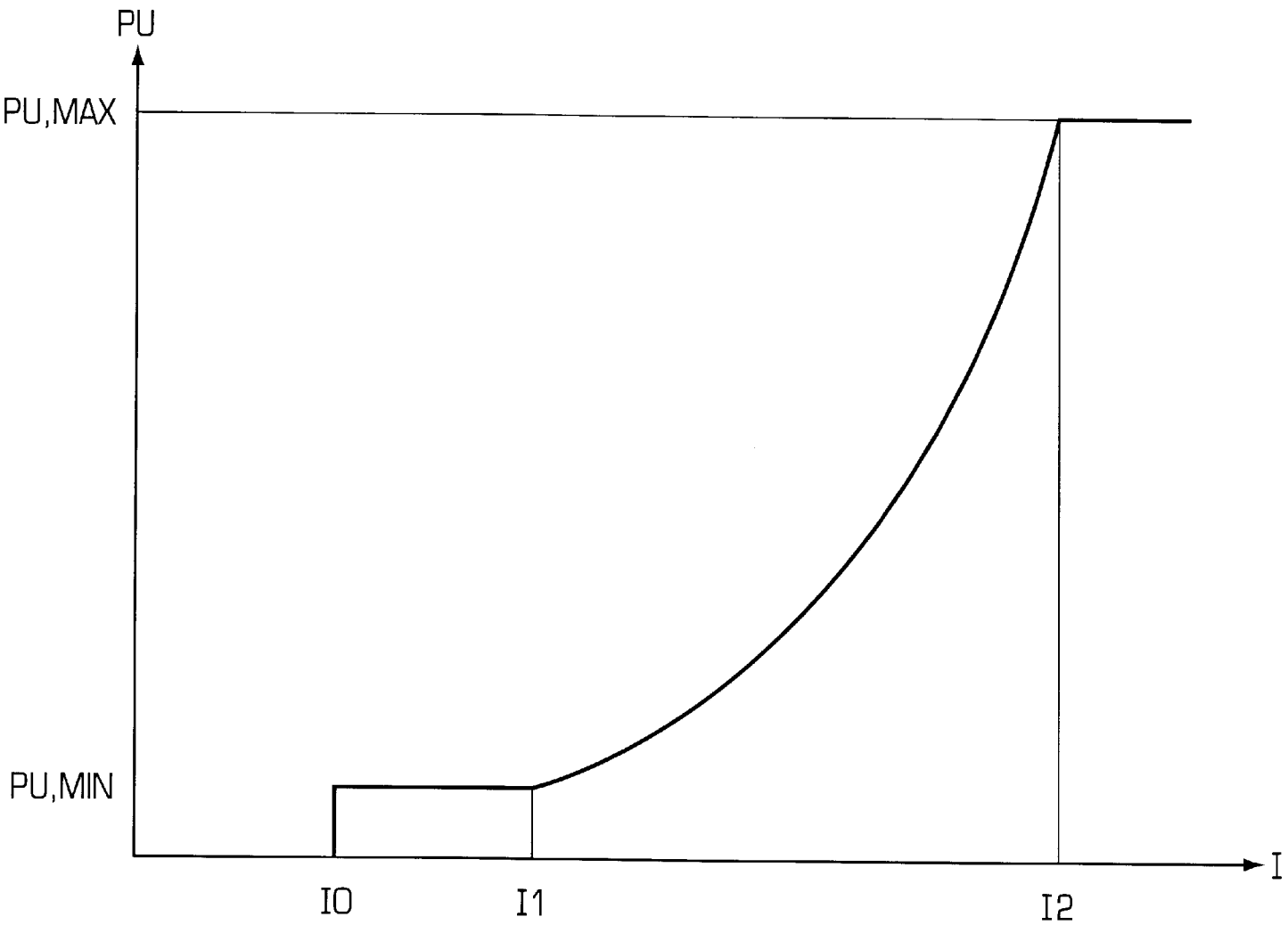

The pressure in the piloting chamber 9 is controlled by a pressure regulator 10, the functional diagram of which is shown in FIG. 4.

Figure 3:
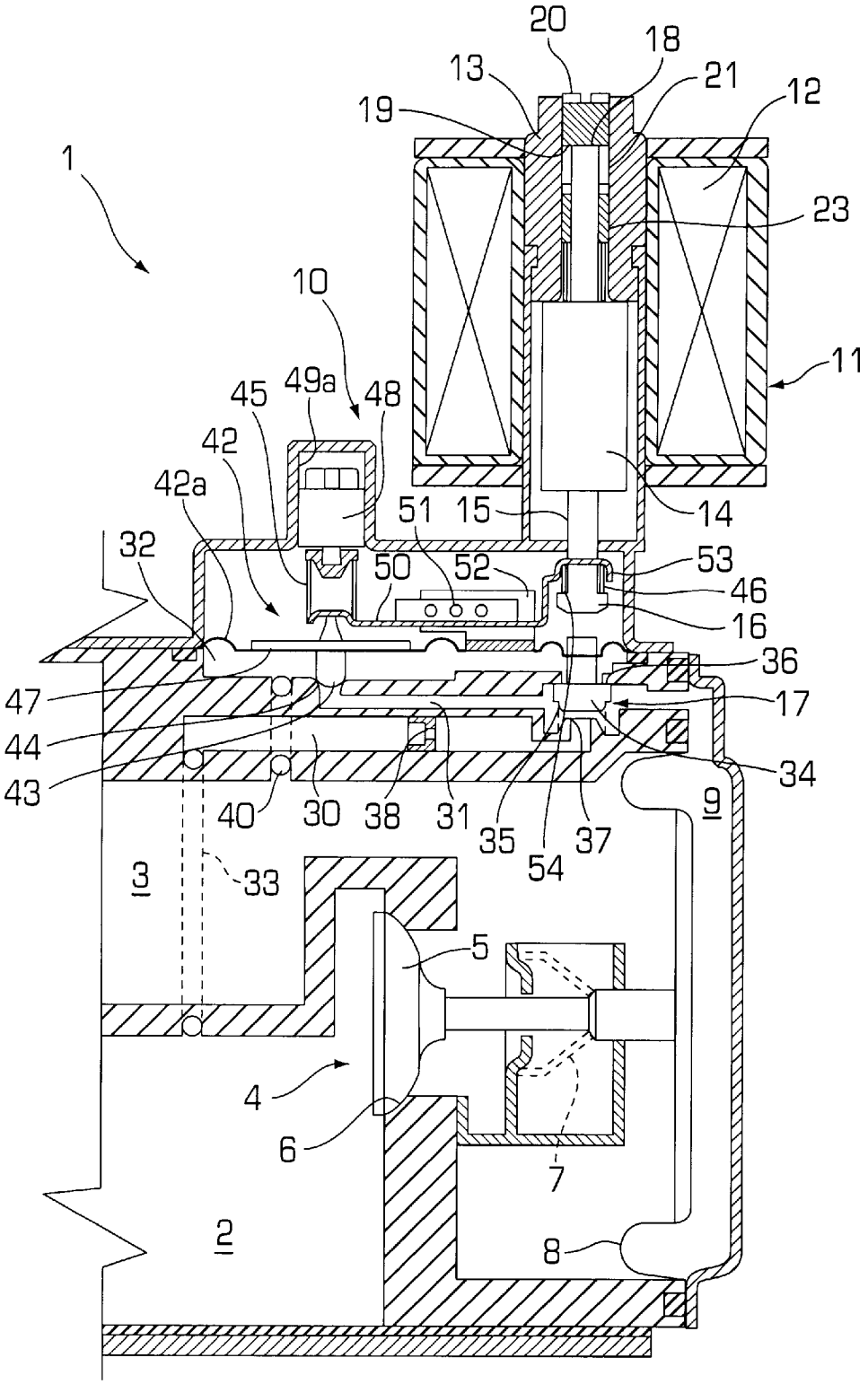

This pressure regulator 10 comprises an electromagnetic actuator 11 including a solenoid 12, a fixed core 13, a movable core 14 and a control rod 15. The movable core 14 is fixed to the control rod 15 in order to move the latter between a first travel limit position (in which the solenoid is de-energized) in which one end 16 of the rod 15 acts on a cut-off valve 17 of the unit 1 to urge it to a closed position (FIG. 1), and a second travel limit position in which the opposite end 18 of the rod 15 abuts an adjustable abutment 19 formed on the surface of a screw 20 screwed into an axial threaded hole 21 of the fixed core 13 (FIG. 3).

The rod 15 is urged towards the first travel limit position of FIG. 1 by the resilient load of a spring 22 which is adjustable by means of a threaded bush 23. The movable core 14 is returned towards the fixed core 13 by magnetic attraction when the solenoid 12 is electrically energized. The return force is proportional to the intensity of the current flowing in the solenoid 12.

The pressure regulator 10 also comprises first, second and third chambers indicated 30, 31 and 32, respectively.

The first chamber 30 is always in communication with the supply duct 2 by means of a first transfer duct 33 and communicates selectively with the piloting chamber 9 and with the second chamber 31 through a calibrated hole 38 and by means of the cut-off valve 17. The latter comprises an obturator 34 which is urged by a spring 35 into closure on a first seat 36 and is movable under the action of the rod 15 so as to close a second seat 37 when the rod is in the first travel limit position of FIG. 1. Since, when the second seat 37 is closed by the obturator 34, the valve 17 brings about complete closure of the servo-valve 4, it will also be referred to in the present context by the term ON-OFF valve.

The third chamber 32 is always in communication with the delivery duct 3 by means of a second transfer duct 40 and communicates selectively with the piloting chamber 9 in order to discharge it when the on-off valve 17 is in the closed position of FIG. 1. The third chamber 32 also communicates with the second chamber 31 by means of a vent valve 42 including a diaphragm **42*a* which is subject to the pressure existing in the delivery duct 3, and carrying an obturator 43 which can close a seat 44** in the manner explained below.

Since the vent valve 42 has the function of piloting the servo-valve 4 for modulating the delivery pressure of the gas in the delivery duct 3 in dependence on the current flowing in the solenoid 12, this valve will also be referred to by the term modulation valve.

Figure 2:
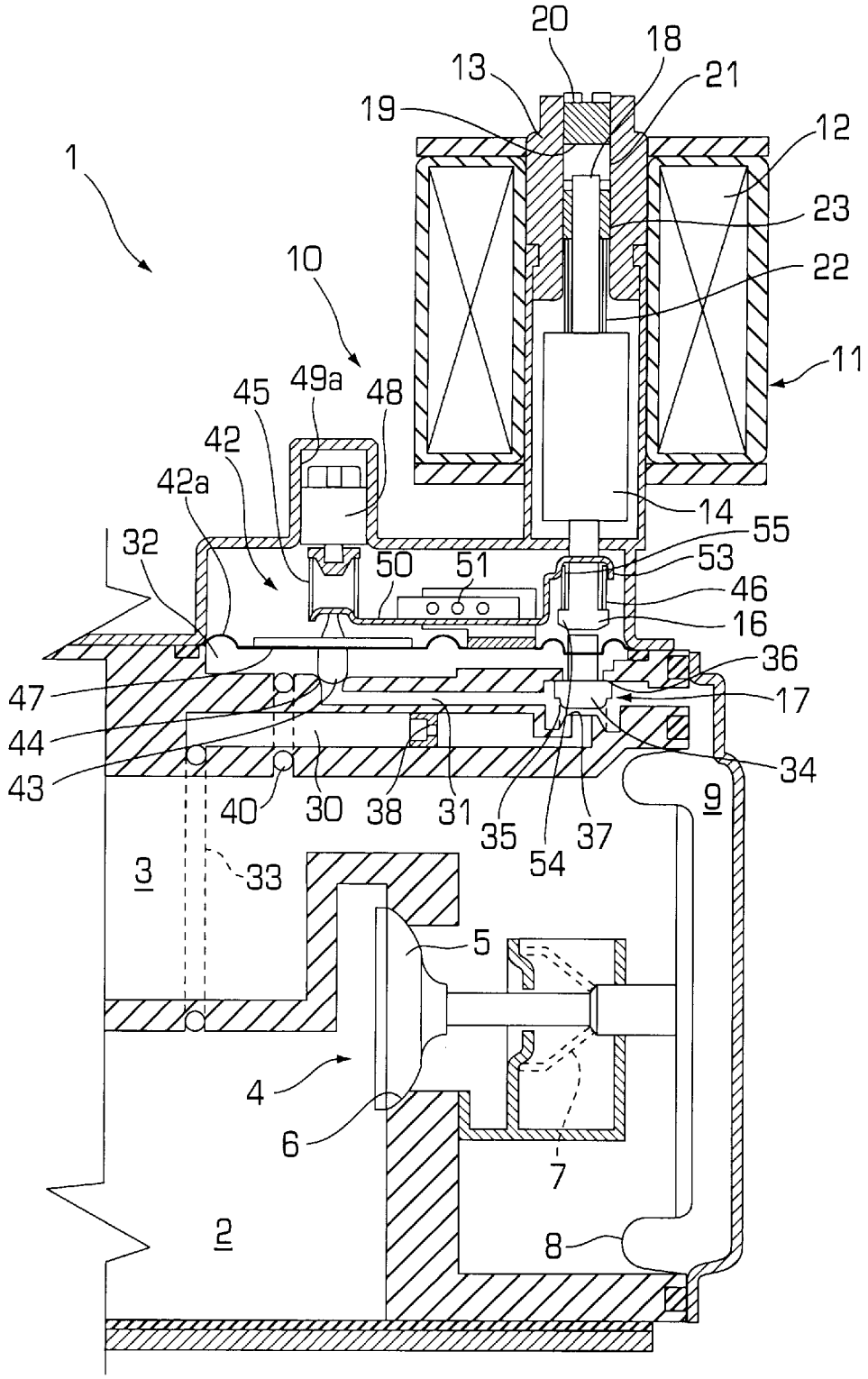

The obturator 43 is subject solely to the resilient load of a low-point spring 45 when the rod 15 is in the first travel limit position (FIG. 1), and to the combined resilient load of the low-point spring 45 and of a modulation spring 46 when the rod 15 is in the second travel limit position (FIG. 3) or in an intermediate modulation position (FIG. 2).

The low-point spring 45 selected is relatively soft and acts directly between a plate 47 carrying the obturator 43 and an abutment 48 which is adjustable by screwing in a threaded hole 49*a*.

The modulation spring 46 acts on the obturator-carrying plate 47 by means of a first-order lever 50 pivoted at an intermediate position thereof on a fulcrum 51 associated with a bracket 52 which is fixed to the stationary structure constituting the body of the servo-valve 1. The position of the fulcrum 51 relative to the arms of the lever 50 is adjustable, for example, by the formation in corresponding positions both on the lever 50 and on the bracket 52 of a plurality of holes 52*a, b, c* spaced at intervals such that the lever 50 can be pivoted in a preselected pair of holes at the construction stage of the valve unit. Alternatively, the bracket 52 may be movable on the stationary portion of the valve unit so that the fulcrum 51 is moved with it to one of three holes 52*a, b, c* of the lever 50 or in a single slotted hole thereof, of a length corresponding to the overall interaxial spacing of the three aforementioned holes.

The modulation spring 46 is housed between a cup-shaped formation 53 at the end of the lever 50 and a shoulder 54 on the end 16 of the rod 15. It can be seen that, when the rod 15 is in the first travel limit position, and as long as any current flowing in the solenoid 12 is below the value I1, there is a clearance 55 between the spring 46 and the cup-shaped formation 53 of the lever 50 so as to ensure that only the low-point spring 45 is operative on the obturator 43 at this stage.

It can also be seen that, by virtue of the structure shown, both the on-off valve 17 and the modulation valve 42 are controlled by a single electromagnetic actuator.

In FIG. 1, the electromagnetic actuator 11 is de-energized (or is energized to an insufficient extent to open the ON-OFF valve). The rod 15 is consequently pushed by the spring 22 to the first travel limit position and the obturator 34 of the valve 17 is disposed so as to close the second seat 37, preventing the pressure of the gas in the first chamber 30, which is equal to the supply pressure in the duct 2, acting in any way on the diaphragm 8 of the servo-valve 4.

When a current I0 sufficient to open the ON-OFF valve 17 is made to flow in the solenoid 12, the chambers 30 and 9 are put into fluid communication by means of the calibrated hole 38. The value of the delivery pressure is continuously detected on the membrane 42*a* by means of the connection established by the second transfer duct 40 between the third chamber 32 and the delivery duct 3.

When the pressure in the delivery duct 3 rises beyond a value sufficient to overcome the resilient load of the low-point spring 45, the obturator 43 is opened venting some of the pressure established in the piloting chamber 9 and in the second chamber 31 so as to reduce the opening of the servo-valve 4 progressively until the pressure in the delivery duct returns to the preselected low-point value. This value is selected by adjustment of the resilient load of the low-point spring 45 by the positioning of the abutment 48.

When a current I2 greater than or equal to a predetermined value for controlling the maximum gas-delivery pressure is made to flow in the solenoid 12, the rod 15 is returned to the second travel limit position of FIG. 3. Both the resilient load of the low-point spring 45 and that derived from the maximum compression of the modulation spring 46 are thus exerted on the obturator 43 of the modulation valve. The operation of the modulation valve 42 is the same as that described with reference to the previous condition with the obvious difference that the pressure in the delivery duct can increase until it balances the combined value of the resilient loads of the two springs, that is, the low-point spring and the modulation spring, on the diaphragm 42*a*.

For current values between I1 and I2 there is only partial compression of the modulation spring, a consequent modulation of the resilient load exerted by the modulation spring 46 on the obturator 43, and a corresponding modulation of the gas pressure in the delivery duct.

The invention thus solves the problem set, permitting fine adjustment and accurate control of the minimum pressure of gas delivered by the unit by virtue of the fact that, for this low-point regulation, it provides for a resilient load which is independent of (and generally lower than) the resilient load of the modulation spring to be exerted on the obturator of the modulation valve. The modulation spring is called upon to act on the obturator of the modulating valve only after a predetermined value of the physical parameters (the current in the solenoid of the electromagnetic actuator) provided for controlling the pressure has been exceeded.

An important advantage achieved by the valve unit of the invention lies in the fact that a single electromagnetic actuator is provided both for controlling the ON-OFF cut-off valve and for controlling the modulation valve. The unit also has a very compact structure and advantageously cheap construction.

What is claimed is:

1. A valve unit for controlling the delivery pressure of a gas comprising:

a servo-valve having an obturator with diaphragm control, the diaphragm being subject, on one side, to the delivery pressure of the gas and, on the other side, to a reference pressure established in a piloting chamber of the servo-valve, a pressure regulator associated with the servo-valve and comprising a modulation valve for controlling the reference pressure in the piloting chamber and an on-off valve for cutting off the supply of gas to the piloting chamber, and actuator means for the operative control of the pressure regulator, wherein the actuator means comprise a single electromagnetic actuator active on both the modulation valve and the on-off valve for the operative control thereof, wherein the modulation valve comprises an obturator with diaphragm control, the obturator being subject, on one side, to the thrust exerted on the diaphragm by the delivery pressure of the gas and, on the other side, to a resilient load which tends to close the modulation valve and is variable between a minimum value and a maximum value upon operation of the actuator, a low-point spring active on the obturator independently of the actuator in order to generate the minimum load, a modulation spring active on the obturator upon operation of the actuator in order to generate the resilient load which is variable up to the maximum value, and wherein the low-point spring and the modulation spring are structurally independent of one another.

2. A valve unit according to claim 1, in which the electromagnetic actuator comprises a solenoid, a fixed core, a movable core, and an operating rod fixed to the movable core and active both on an obturator of the on-off valve and on an obturator of the modulation valve, for the operative control of both.

3. A valve unit according to claim 2, in which the modulation spring is interposed between the movable core and the obturator of the modulation valve.

4. A valve unit according to claim 3, in which the modulation spring is active on the obturator of the modulation valve by means of a first order lever.

5. A valve unit according to claim 4, in which the lever is pivoted at an intermediate position thereof, on a stationary structure of the valve unit, the position of the fulcrum relative to the arms of the lever being adjustable.

6. A valve unit according to claim 1, in which the modulation spring is mounted coaxially on the operating rod.

7. A valve unit according to claim 6, in which the operating rod has a free end active directly on the obturator of the on-off valve, the modulation spring being fitted on the rod on the free end thereof.

8. A valve unit according to claim 7, in which regulation means active on the low-point spring are provided for regulating the resilient load exerted thereby on the obturator of the modulation valve.

9. A valve unit according to claim 1 in which, for predetermined operative conditions of the actuator corresponding to the minimum resilient load, a predetermined clearance is provided between the modulation spring, the actuator and the obturator of the modulation valve, such that solely the minimum spring is active on the obturator.

* * * * *